US005397190A

United States Patent [19]

Iida

[11] Patent Number: 5,397,190

[45] Date of Patent: Mar. 14, 1995

[54] PRINTED SLIP ISSUING APPARATUS

[75] Inventor: Yoshinori Iida, Shizuoka, Japan

[73] Assignee: Tokyo Electric Co., Ltd., Tokyo, Japan

[21] Appl. No.: 139,823

[22] Filed: Oct. 22, 1993

[51] Int. Cl.[6] ..... B41J 11/48

[52] U.S. Cl. ..... 400/593; 400/621; 83/444

[58] Field of Search ..... 400/593, 585, 587, 590, 400/621, 621.1, 621.2; 101/226, 227; 156/510; 83/444

[56] References Cited

U.S. PATENT DOCUMENTS

| | | | |
|---|---|---|---|
| 4,293,236 | 10/1981 | Shimizu | 400/593 |
| 4,560,990 | 12/1985 | Sue et al. | 400/621 |
| 5,041,845 | 8/1991 | Ohkubo et al. | 400/621 |
| 5,302,037 | 4/1994 | Schoendienst | 400/621 |

FOREIGN PATENT DOCUMENTS

| | | | |
|---|---|---|---|
| 0457584 | 11/1991 | European Pat. Off. | 400/621 |
| 3516912 | 11/1985 | Germany | 400/621 |
| 56-162687 | 12/1981 | Japan . | |
| 62-135146 | 6/1987 | Japan . | |
| 0059369 | 2/1990 | Japan | 400/621 |
| 0015574 | 1/1991 | Japan | 400/621 |
| 2161757 | 1/1986 | United Kingdom | 400/248 |

OTHER PUBLICATIONS

"Forms Buster" IBM Technical Disclosure Bulletin vol. 19, No. 8 Jan. 1977 pp. 2984–2985.

"Paper Guillotine, Platen Guide & Feed Mechanism" IBM Tech. Disclosure Bulletin, vol. 26, No. 7A, Dec. 1983 pp. 3333–3334.

*Primary Examiner*—Eugene H. Eickholt

*Attorney, Agent, or Firm*—Oblon, Spivak, McClelland, Maier & Neustadt

[57] ABSTRACT

A printed slip issuing apparatus is provided with a cutting blade having a cutting portion and disposed with its cutting portion extending along the width of a form web at a position immediately below a printing unit for printing on the form web, and a nipping member disposed near and opposite to the cutting portion of the cutting blade so as to form a web nipping region in combination with the cutting portion. When cutting off a printed portion of the the form web, the form web is nipped between the cutting portion of the cutting blade and the nipping member in the web nipping region to enable the cutting blade cut off the printed portion clearly.

24 Claims, 6 Drawing Sheets

PRINTED SLIP ISSUING APPARATUS

BACKGROUND OF THE INVENTION

1. Field of the Invention

The present invention relates to a printed slip issuing apparatus having a function of cutting off a printed slip, such as a label or a receipt, from a form web and to issue the printed slip.

2. Description of the Related Art

A label printer, as an example of a known printed slip issuing apparatus, will be described with reference to FIGS. 9 and 10. A print head 2 is pressed resiliently against a platen roller 1, and a form web 5 formed by laminating a label 3 and a base web 4 is held between the platen roller 1 and the print head 2. A separating plate 6 for separating the label 3 from the base web 4 by sharply bending the label 3 is disposed below a printing unit including the print head 2. A cutting blade 7 is fastened to the front surface of the print head 2 with a fixed gap between the saw-toothed cutting edge thereof and the separating plate 6. The cutting blade 7 extends along the width of the base web 4 and projects obliquely downward from the front surface of the print head 2.

The print head 2 prints on the base web 4 as the form web 5 is advanced. The separating plate 6 bends the label 3 sharply to separate the same from the base web 4. The printed portion of a specified length of the base web 4 is cut off from the label 3 by the cutting blade 7 to obtain a label or a printed slip.

When cutting the printed portion of the base web 4 off the base web 4 with the cutting blade 7, the base web 4 is not held firmly and is cut by pressing the same against the cutting blade 7, because the cutting edge of the cutting blade 7 is apart from the separating plate 6. Therefore, the base web 4 is not necessarily cut satisfactorily. Since the printed portion of the base web 4 is cut with the base web 4 in an unstable state, it is difficult to cut the base web 4 well along a desired cutting line.

SUMMARY OF THE INVENTION

Accordingly, it is a first object of the present invention to provide a printed issuing apparatus capable of surely and satisfactorily cutting a printed portion of a base web along a desired line.

A second object of the present invention is to provide a printed slip issuing apparatus capable of protecting the printed surface of a base web from a cutting blade.

A third object of the present invention is to provide a printed slip issuing apparatus provided with a cutting blade capable of being readily removed.

In one aspect of the present invention, a printed slip issuing apparatus comprises: a printing unit disposed on a guide path for guiding a form web to a predetermined feed path; a cutting blade disposed at the front end of the guide path with its cutting edge extended along a direction perpendicular to the direction of movement of the form web; a web holding member disposed near the cutting edge of the cutting blade on the opposite side of the cutting edge of the cutting blade with respect to the guide path to hold the form web between the web holding member and the cutting edge of the cutting blade. The form web formed by laminating a label and a base web is guided by the guide path to the predetermined feed path, a winding shaft for taking up the label of the form web is disposed at the front end of the guide path, the printing unit is disposed on the guide path, the cutting blade is disposed so that its cutting edge extends along the width of the form web, a separating member for separating the backup label from the base web by sharply bending the label is disposed near and opposite to the cutting edge of the cutting blade with respect to the guide path to hold the form web between the separating member and the cutting edge of the cutting blade. Since the form web is pressed along a cutting line against the cutting edge by the separating member, the cutting blade is able to cut the base web of the form web satisfactorily along the desired cutting line.

DETAILED DESCRIPTION OF THE PREFERRED EMBODIMENTS

Figure 1:
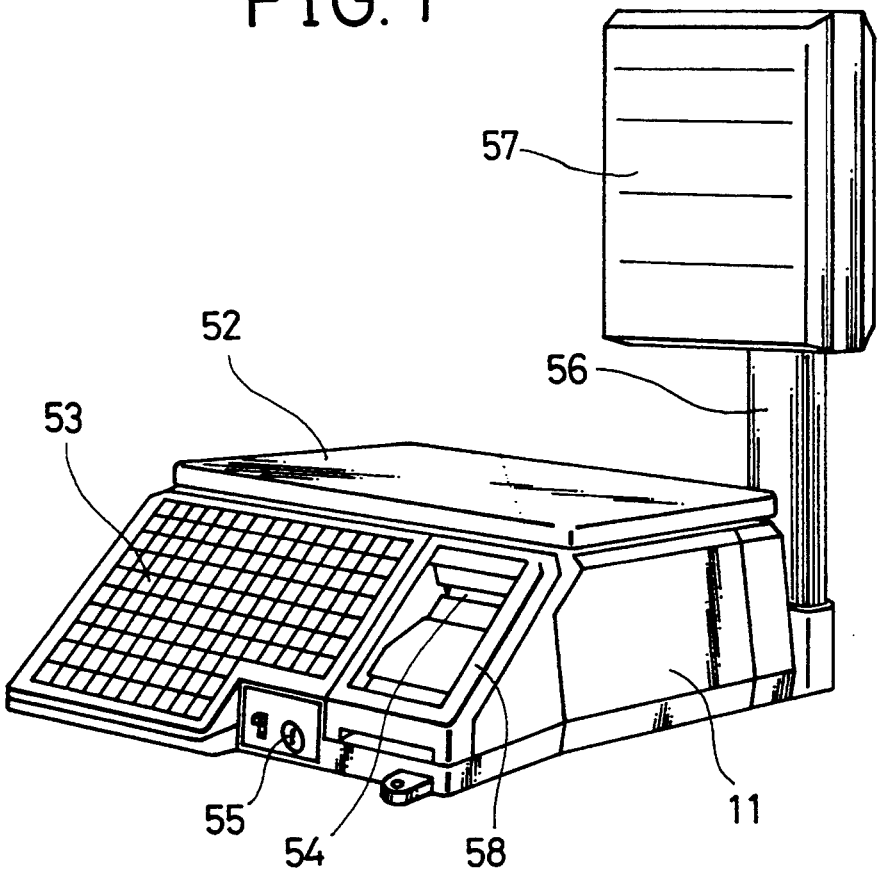
FIG. 1 is a perspective view of a load cell scale provided with a label printer in a first embodiment according to the present invention.

A preferred embodiment of the present invention as applied to a label printer incorporated into a load cell scale will be described with reference to FIGS. 1 to 8. A scale unit including a load cell, and a label printer are contained in a case 11. The construction of the scale unit and the electrical configuration of the label printer are not directly connected with the present invention and hence the description thereof will be omitted. Referring to FIG. 1 showing the load cell scale provided with the label printer, a scale pan 52 connected to the load cell is supported over the upper wall of the case 11. The front surface of the case 11 is inclined to facilitate the operation of the load cell scale. A key board 53, a label issuing slot 54 and a mode selector key 55 are arranged on the front surface of the case 11. A display 57 is attached to a post 56 set behind the case 11 in an upright position. The label issuing slot 54 is formed in a printer case 58 detachably attached to the case 11.

Figure 2:
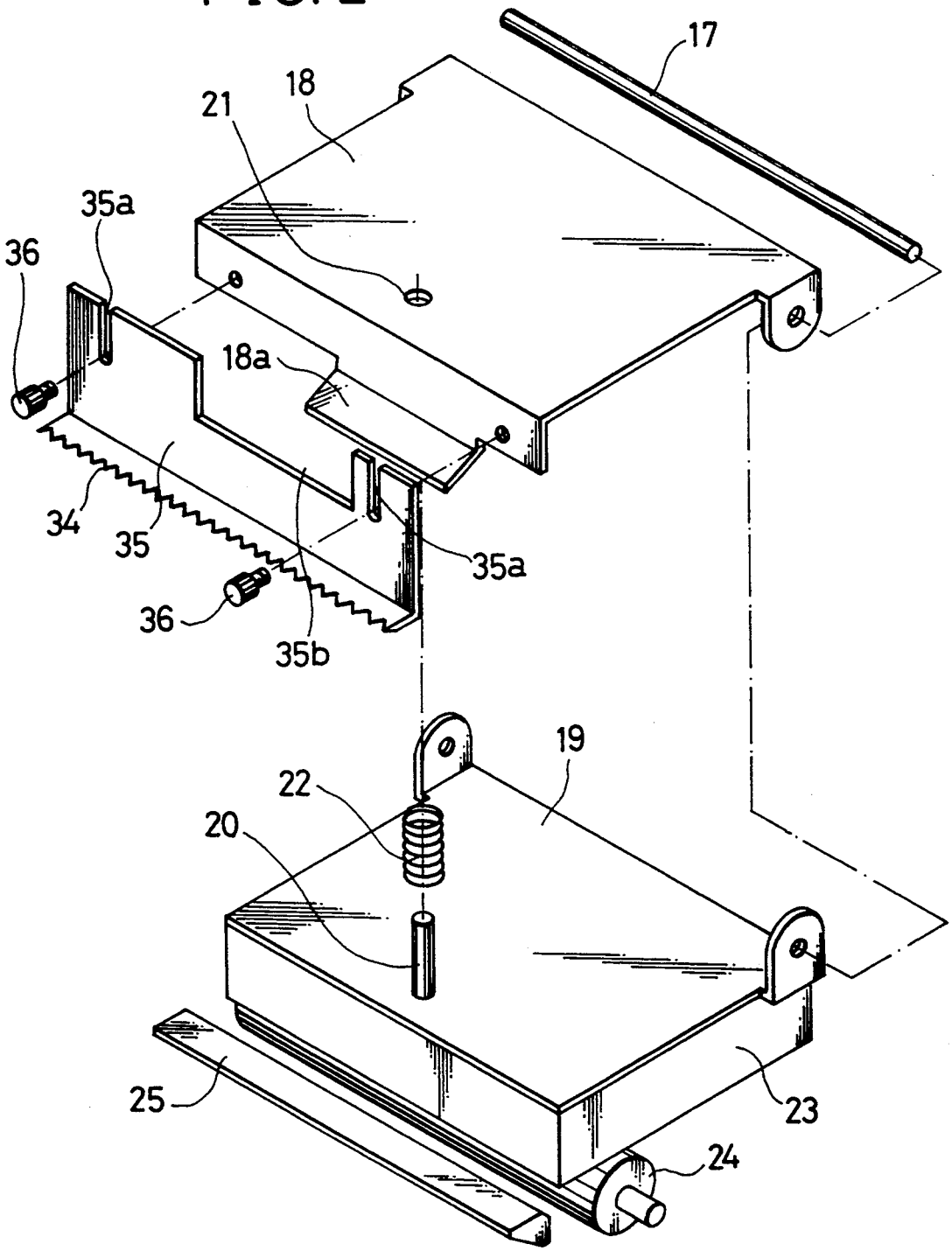
FIG. 2 is an exploded perspective view of an essential portion of the load cell scale of FIG. 1.
Figure 3:
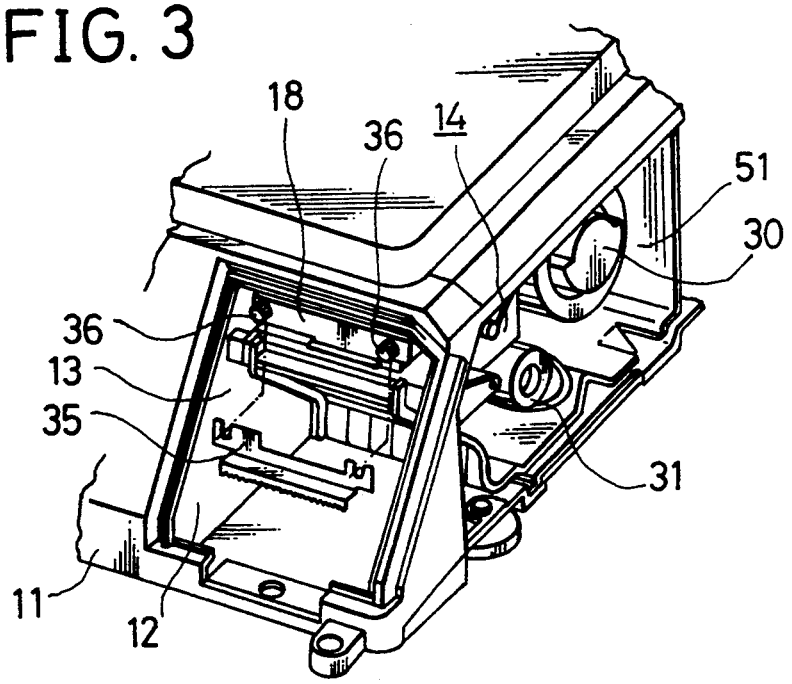
FIG. 3 is a perspective view of an essential portion of the label printer included in the load cell scale of FIG. 1.
Figure 4:
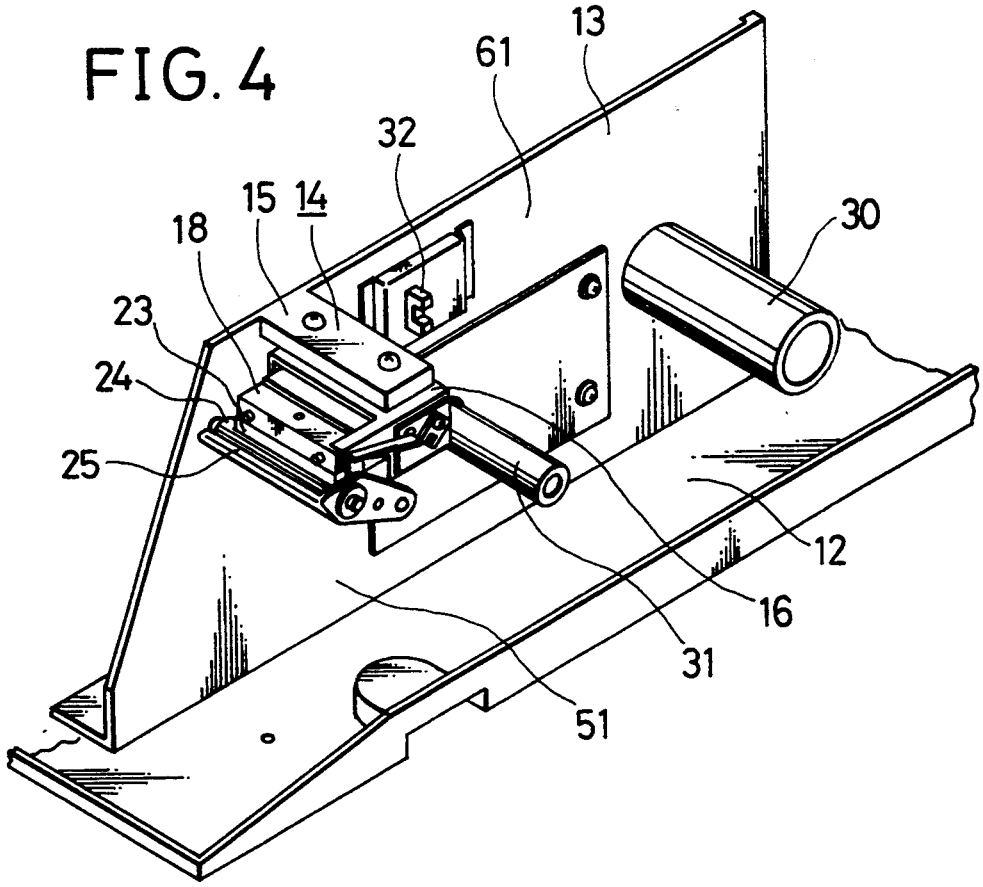
FIG. 4 is a perspective view of a printing unit included in the load cell scale of FIG. 1.
Figure 5:
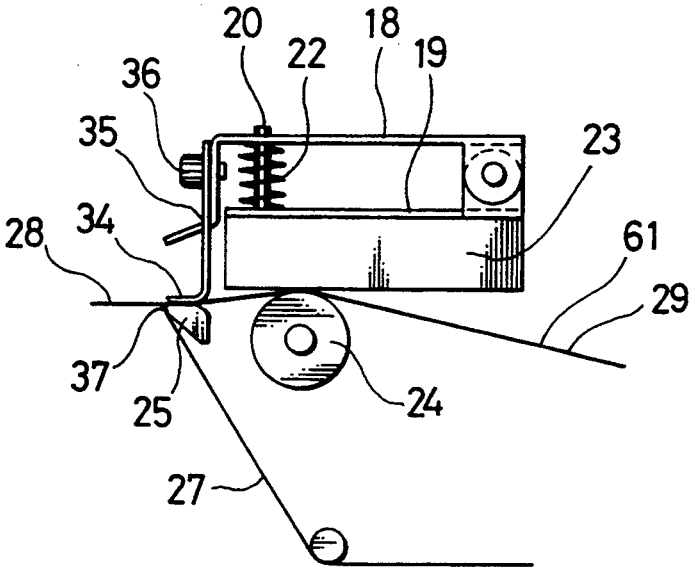
FIG. 5 is a side view of an essential portion of the printing unit of FIG. 4.
Figure 6:
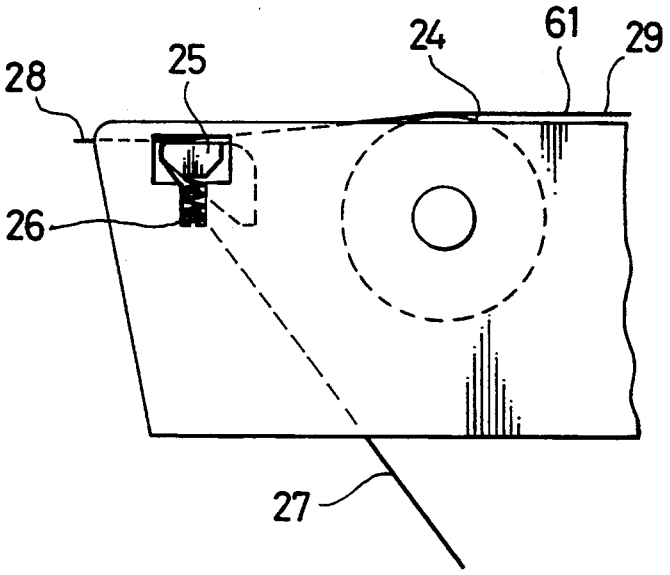
FIG. 6 is a side view of a structure holding a separating plate.
Figure 7:
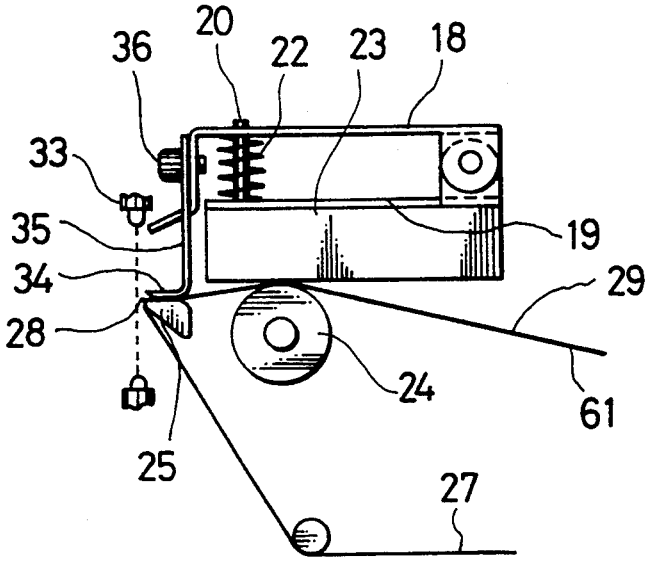
FIG. 7 is a side view showing the disposition of a sensor and the separating plate shown in FIG. 6.

As shown in FIGS. 2–4, a frame 12 is placed within the case 11, and an integral printing unit 14 is held on the vertical member 13 of the frame 12. A holding arm 15 formed integrally with the vertical member 13 extends horizontally from the upper edge of the vertical member 13. The printer 14 is attached to the holding arm 15. The printer 14 has a printer frame 16, and a pressure plate 18 and a print head holding plate 19 are supported pivotally on the printer frame 16 by the pivot shaft 17. A pin 20 (FIG. 2) is fixed to the print head holding plate 19 in an upright position, an opening 21 is formed in the pressure plate 18 at a position corresponding to the pin 20, and a compression spring 22 is put on the pin 20 so as to be compressed between the pressure plate 18 and the print head holding plate 19. The pressure plate 18 is located relative to the printer frame 16, and the print head holding plate 19 is biased away from the pressure plate 18 by the compression spring 22. A print head 23 is fastened to the print head holding plate 19 with screws, not shown. A platen roller 24 is supported for rotation on the printer frame 16 opposite to the print head 23 and connected to a driving unit including a stepping motor, not shown. As shown in FIGS. 5–6, a separating plate 25, which serves as both a web holding member and a label separating member, is supported for vertical movement on the printer frame 16 and biased upward by a spring 26. The separating plate 25 is restrained from horizontal movement. A lug 18*a* (FIG. 2) projects from the lower edge of the vertical front portion of the pressure plate 18. The lug 18*a* is depressed with a finger to press the print head 23 against the platen roller 24.

A rolled form web 29 formed by laminating a label 27 and a base web 28 is supported on a roll holding shaft 30. The form web 29 travels past a region between the print head 23 and the platen roller 24, the label 27 is bent sharply by the separating plate 25 to separate the same from the base web 28, and the label 27 is taken up on a takeup reel 31 rotated by a driving unit, not shown. As shown in FIG. 4, a form web detecting unit 32 for detecting the form web 29 is disposed on a guide path 61 along which the form web 29 travels. A printed slip detecting unit 33 (FIG. 7) for detecting a printed slip cut off from the base web 28 is disposed near the separating plate 25.

A cutting blade 35 having a sawtoothed cutting edge 34 is fastened to the vertical front portion of the pressure plate 18 with two screws 36 each having a knurled head so that the cutting edge 34 extends along the width of the form web 29. The cutting edge 34 projects horizontally. The vertical position of the cutting blade 35 relative to the pressure plate 18 is adjusted so that the lower surface of the horizontal cutting edge 34 is in contact with the upper surface of the separating plate 25 to form a pinching region 37. The cutting blade 35 is provided with recesses 35*a* through which the screws 36 are passed, and a recess 35*b* through which the lug 18*a* of the pressure plate 18 projects (FIG. 2).

When the platen roller 24 is driven for rotation to feed the form web 29, the print head 23 prints on the surface of the base web 28. As the form web 29 is fed by the platen roller 24, the takeup reel 31 is driven to take up the label 27. The label 27 is pulled by the takeup reel 31 with a tension that will not adversely affect the feed of the form web 29 by the platen roller 24. The taut label is bent sharply at the edge of the separating plate 25, so that the base web 28 is separated from the label 27 and projects forward. When the cutting blade 35 is pressed against the separating plate 25, the separating plate 25 sinks slightly. Although the pulling force applied to the label 27 acts on the separating plate 25, the vertical component of the force is counterbalanced by the resilience of the spring 26 and hence the separating plate 25 does not sink any further.

A printed portion, i.e., a label or a printed slip, of the base web 28 separated from the label 27 is cut off from the base web 28 with the cutting blade 35. When cutting off the printed portion of the base web 28, the leading end of the printed portion is pulled upward. Since the form web 29 is held between the cutting blade 35 and the separating plate 25, the base web 28 of the form web 29 is cut cleanly and accurately along a desired cutting line by the cutting edge 34 of the cutting blade 35. Thus, a label or a printed slip of a predetermined length is provided.

Since the cutting blade 35 has a cross section substantially resembling the letter L, the separating plate 25 is pressed against the smooth, flat surface of the cutting blade 35 by the spring 26. Accordingly, the cutting edge 34 of the cutting blade 35 will not damage the printed surface of the base web 28 and the cutting blade will not spoil images printed on the base web 28.

Since the cutting blade 35 is attached to the pressure plate 18 and the printer case 58 containing the printing unit can be removed from the case 11 as shown in FIG. 3, the cutting blade 35 can be readily removed from the pressure plate 18 for maintenance or replacement. The knurled heads of the screws 36 enable tightening and loosening the screws 36 by hand, which facilitates fastening of the cutting blade 35 to and removing of the same from the pressure plate 18.

The present invention is applicable to a printed slip issuing apparatus which prints on a paper web, cuts a printed portion of the paper web in a printed slip and issues the printed slip as a receipt. In the pinching region 37, the separating plate 25 need not necessarily be in contact with the cutting blade 35; the separating plate 25 may be held with a small gap between the separating plate 25 and the cutting blade 35.

Figure 8:
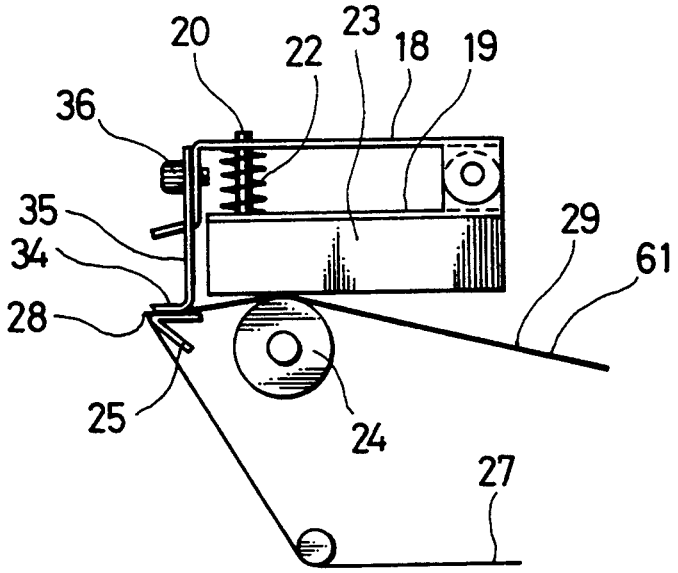
FIG. 8 is a side view of another possible separating plate.
Figure 9:
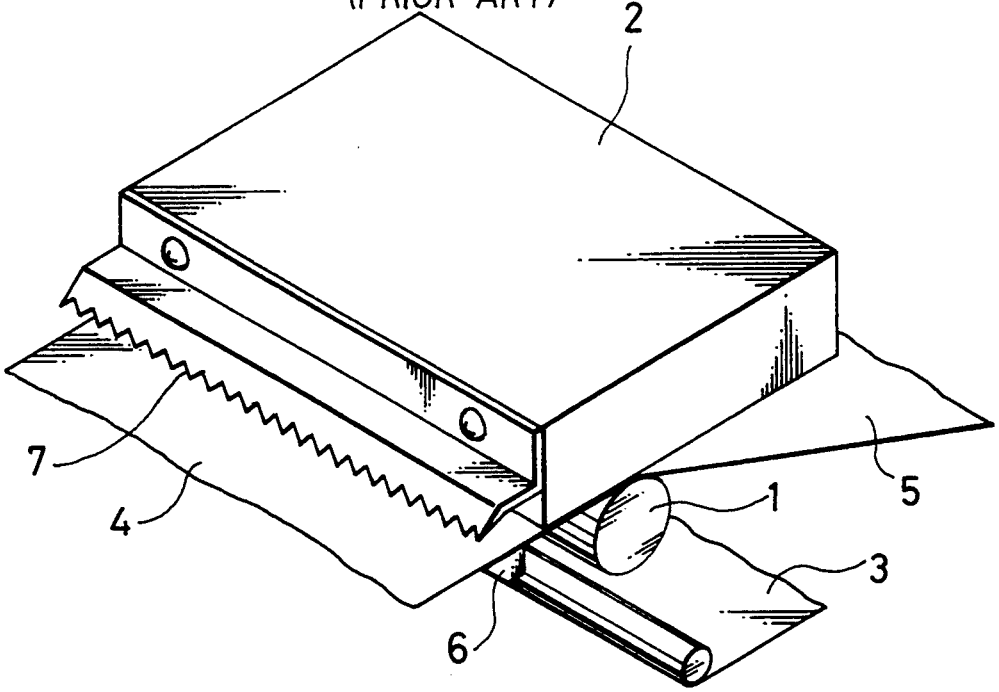
FIG. 9 (PRIOR ART)
FIG. 9 is a perspective view of a known label printer.
Figure 10:
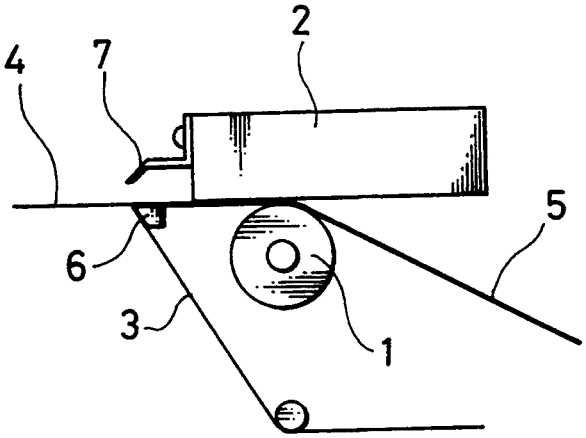
FIG. 10 (PRIOR ART)
FIG. 10 is a side view of the known label printer of FIG. 9.

FIG. 8 shows another possible separating plate 25. The separating plate 25 is formed by bending a plate. A separating plate of any shape may employed, provided that the separating plate has an edge capable of sharply bending a web.

What is claimed is:

1. A printed slip issuing apparatus comprising:

a guide means defining a guide path along which a form web travels;

a printing unit for printing on the form web fed thereto along the guide path;

a cutting blade having a cutting portion and extended along the width of the form web at a position immediately below the printing unit with respect to the direction of travel of the form web; and a nipping member disposed near and opposite to the cutting portion of the cutting blade so as to form a web nipping region in combination with the cutting portion of the cutting blade;

wherein the cutting portion of the cutting blade extends along the direction of advancement of the form web, and the cutting portion of the cutting blade has a smooth, flat surface facing the nipping member.

2. A printed slip issuing apparatus according to claim 1, wherein the cutting blade has a cross section substantially resembling the letter L.

3. A printed slip issuing apparatus according to claim 2, wherein the cutting blade having a cross section substantially resembling the letter L is attached to a print head holding member holding a print head.

4. A printed slip issuing apparatus according to claim 3, wherein the cutting blade is fastened to the print head holding member with screws capable of being tightened by hand.

5. A printed slip issuing apparatus according to claim 1, wherein the nipping member is supported so as to be movable toward and away from the cutting portion of the cutting blade and biased resiliently toward the cutting portion.

6. A printed slip issuing apparatus according to claim 1, wherein a web holding means holds a roll of form web at a position near the entrance of the guide path.

7. A printed slip issuing apparatus comprising:

a guide means defining a guide path along which a form web formed by laminating a base web and a label travels;

a takeup shaft for taking up the label separated from the base web;

a printing unit for printing on the base web of the form web traveling along the guide path;

a cutting blade having a cutting portion and extended along the width of the form web at a position immediately below the printing unit with respect to the direction of travel of the form web; and a separating member disposed near and opposite to the cutting portion of the cutting blade to separate the label from the base web by sharply bending the label and to form a web nipping region in which to nip the form web in combination with the cutting portion of the cutting blade.

8. A printed slip issuing apparatus according to claim 7, wherein the cutting portion of the cutting blade is extended along the direction of advancement of the base web, and the cutting portion has a smooth, flat surface facing the separating member.

9. A printed slip issuing apparatus according to claim 8, wherein the cutting blade has a cross section substantially resembling the letter L.

10. A printed slip issuing apparatus according to claim 9, wherein the cutting blade having a cross section substantially resembling the letter L is attached to a print head holding member holding a print head.

11. A printed slip issuing apparatus according to claim 10, wherein the cutting blade is fastened to the print head holding member with screws capable of being tightened by hand.

12. A printed slip issuing apparatus according to claim 7, wherein the separating member is supported so as to be movable toward and away from the cutting portion of the cutting blade and biased resiliently toward the cutting portion.

13. A printed slip issuing apparatus according to claim 7, wherein a web holding means holds a roll of form web at a position near the entrance of the guide path.

14. A printed slip issuing apparatus comprising:

a printing unit for printing on a form web fed thereto along a guide path;

a cutting blade having a cutting portion extending along the width of the form web at a position downstream from the printing unit with respect to the direction of travel of the form web; and a nipping member disposed near and opposite to the cutting portion of the cutting blade so as to form a web nipping region in combination with the cutting portion of the cutting blade;

wherein the cutting portion of the cutting blade extends along the direction of advancement of the form web, and the cutting portion of the cutting blade has a smooth, flat surface facing the nipping member.

15. The apparatus of claim 14, wherein the cutting blade is mounted on a pressure plate, and wherein said printing unit includes a print head, and further wherein a spring is disposed between said pressure plate and said print head.

16. The apparatus of claim 15, wherein said pressure plate and a print head holding plate are pivotally supported on a printer frame, and wherein said spring is disposed between said pressure plate and said print head holding plate.

17. The apparatus of claim 16, further including a pin extending from said print head holding plate, and wherein said spring is disposed about said pin.

18. The apparatus of claim 15, wherein said pressure plate includes a lug extending therefrom.

19. The apparatus of claim 18, wherein said lug projects through a recess of said cutting blade.

20. The apparatus of claim 14, wherein said nipping member is a separating plate, the apparatus further including means for biasing the separating plate upwardly.

21. The apparatus of claim 14, wherein said cutting blade has an L-shaped cross-section, and a base of the L-shape is disposed opposite to said nipping member.

22. The apparatus of claim 7, wherein said cutting blade is mounted on a pressure plate, and wherein a spring is disposed between said pressure plate and a print head of said printing unit.

23. The apparatus of claim 22, wherein said cutting blade has an L-shaped cross-section and wherein a base of the L-shape is disposed opposite to said separating member.

24. The apparatus of claim 22, wherein said pressure plate is pivotally mounted on a printer frame.

* * * * *